United States Patent [19]

Davison

[11] 4,218,013

[45] Aug. 19, 1980

[54] SHOWER HEAD FLUID DISPENSER

[76] Inventor: Charles A. Davison, P.O. Box 11005, Dallas, Tex. 75223

[21] Appl. No.: 932,798

[22] Filed: Aug. 11, 1978

[51] Int. Cl.[2] ..... B67D 5/38

[52] U.S. Cl. ..... 239/74; 239/282; 239/305; 239/318; 239/348

[58] Field of Search ..... 239/305, 310, 318, 348, 239/446, 74, 282; 222/484

[56] References Cited

U.S. PATENT DOCUMENTS

| | | | |
|---|---|---|---|
| 828,590 | 8/1906 | Wright | 239/74 |
| 2,073,307 | 3/1937 | Isenberg | 239/282 |
| 3,191,869 | 6/1965 | Gilmour | 239/348 |
| 3,333,601 | 8/1967 | Lofgreen | 239/318 |
| 3,763,888 | 10/1973 | Duecker | 239/318 |

FOREIGN PATENT DOCUMENTS

| | | | |
|---|---|---|---|
| 770336 | 9/1934 | France | 239/305 |

*Primary Examiner*—Robert B. Reeves
*Assistant Examiner*—Michael J. Forman
*Attorney, Agent, or Firm*—Crisman & Moore

[57] ABSTRACT

Fluid mixing and dispensing shower head and suspendible supply reservoir for portable connection to a conventional shower head. The valve block is constructed for quick, intermediate securement between the shower head and supply pipe and is adapted to be operated in conjunction with the shower fixture for selectively dispensing one of a plurality of select liquids into the water stream discharged by the shower nozzle. A plurality of separately accessible containers are provided in a storage bracket suspended beneath the shower head to store distinct quantities of fluids to be dispensed. A suitable selector valve is provided adjacent the storage reservoir to channel the select fluid into the shower head. The containers are housed in a transparent bracket, suspended from the shower head, to permit the user to determine the amount of liquid remaining in each container and the type of liquid selected. A valve is also provided in the shower head for selectively controlling the amount of fluid dispensed through the shower head. The valve has a select passageway positionable within said inlet and outlet when the valve is in a certain position to effect the supply of clear water through the shower nozzle and/or any of the select liquids provided therebeneath.

5 Claims, 8 Drawing Figures

SHOWER HEAD FLUID DISPENSER

BACKGROUND OF THE INVENTION

The present invention relates to devices for selectively dispensing liquids, and, more particularly, to a shower head and supply bracket assembly for selectively dispensing one of a plurality of chemicals in a configuration readily adaptable to all shower heads.

Varieties of devices and methods have heretofore been employed for providing means for selectively delivering water and/or mixtures of water and certain liquids, such as soap or shampoo, through a shower spray. Such prior art devices are generally incorporated into the shower head in one construction or another utilizing the venturi effect to draw the select fluid from a fluid reservoir. One such prior device has incorporated means for placing a tubular pellet or the like in the path of the water flow, such that the materials within the tubular pellet are dissolved by the water and carried away in the flow of the water to the user of the shower. This apparatus is advantageous when the soap or shampoo is provided in pellet form.

Various other prior art devices have been incorporated for dispensing select liquids into the water stream of a shower head which are controllably brought into position by valve means permitting the entire contents of capsules to be drawn into the flow of water and mixed therewith. Such devices are shown and described in the following U.S. Patents:

| U.S. Pat. No. | Date of Issuance |
|---|---|
| 3,628,732 | December 21, 1971 |
| 3,720,352 | March 13, 1973 |
| 3,713,585 | January 30, 1973 |
| 2,609,232 | September 2, 1952 |

From the above patents, it may be seen that soap mixing and dispensing shower heads utilizing valve blocks are conventional in the prior art. Similarly, slide valves are generally provided in the valve block which are mainly moveable along the axis from one position to another for selecting a clear supply of water or the predefined liquid to be dispensed therethrough.

Although must prior art devices have functioned in an acceptable manner, certain disadvantages are prevalent. One such disadvantage is that certain devices do not use commercially available products, that is, the prior art devices generally require a special pellet or capsule which is not readily available. The user is thus unable to obtain the specific liquid such as oil and/or shampoo other than that provided in the specific configuration adaptable to the shower head device. Other prior art devices prevent the user from being able to selectively vary the amount and type of liquid desired to be mixed with the shower flow. Certain other prior art devices provide a variation of the liquids but do not provide them in a manner facilitating the use of commercial shampoos and/or oils and in a manner facilitating their widespread use. Other such prior art devices are limited to a permanent installation adjacent the shower head and/or in an unsightly assemblage in the shower stall. For example, devices which only plumbers may install and/or which upstand from the shower head have proven to be disadvantageous for commercial and economic reasons.

It would therefore be an advantage to provide a generally portable shower head dispenser assembly permitting the use of any of a variety of commercially available liquids for being dispensed through a shower head in a selectively controllable fashion adjacent thereto. The present invention provides such an assembly wherein an inline valve is constructed for assembly to the shower head directly with a flexible tubular member depending therefrom for communication with a selecting valve affixed to a suspendible reservoir assembly. In this manner, commercial liquids may be used to fill and/or be used directly in the storage reservoir, hung from the shower head, and the precise liquid selectively chosen for receipt through the shower head. The valve is constructed for inline assembly to conventional shower heads and provides for the connection of a flexible tubular member therefrom for facilitating installation in all conventional showers.

SUMMARY OF THE INVENTION

The present invention relates to fluid mixing and dispensing devices for use in showers, baths and the like. More particularly, one aspect of the invention includes an inline valve block for securement adjacent the shower head intermediate the supply pipe and the shower head, the valve having a fluid flow control valve constructed therein for varying the amount of liquid drawn therethrough. The valve block has a flow channel formed therein with a lower portion of greater diameter than an upper portion and provided for passage of shower water therethrough. The valve block also includes a depending communication with the flow channel in the area of the interface between the lower and upper portions wherein a venturi draft will be imparted to the depending communication passage. A fluid supply reservoir is suspended beneath the shower head and houses a plurality of fluid containers. Each fluid container is connected to the valve block with tubular members for supplying the fluid to the valve block for discharge therefrom. The tubular members are in communication with the depending passage and one of the containers wherein a venturi draft will precipitate fluid flow therebetween. A selector valve is disposed between the valve block and the fluid supply reservoir and in communication with the tubular members between the valve block and the fluid supply reservoir for channeling the select fluid flow therebetween.

In yet another aspect, the invention includes the fluid supply reservoir in the form of a housing constructed of plastic, which is preferably opaque, and having at least two suction cups mounted on the rear side thereof. The top of the housing includes a mounting bracket for hanging from the shower head and suspending the fluid containers therebeneath. The suction cups then engage the shower wall for providing rigidity and placement. In this manner the apparatus of the present invention can be quickly mounted and demounted in the shower and/or used interchangeably with a single liquid bottle secured directly to the valve block.

BRIEF DESCRIPTION OF THE DRAWINGS

For a more complete understanding of the present invention, and for further objects and advantages thereof, reference may be now had to the following description taken in conjunction with the accompanying drawings in which.

DETAILED DESCRIPTION

Figure 1:
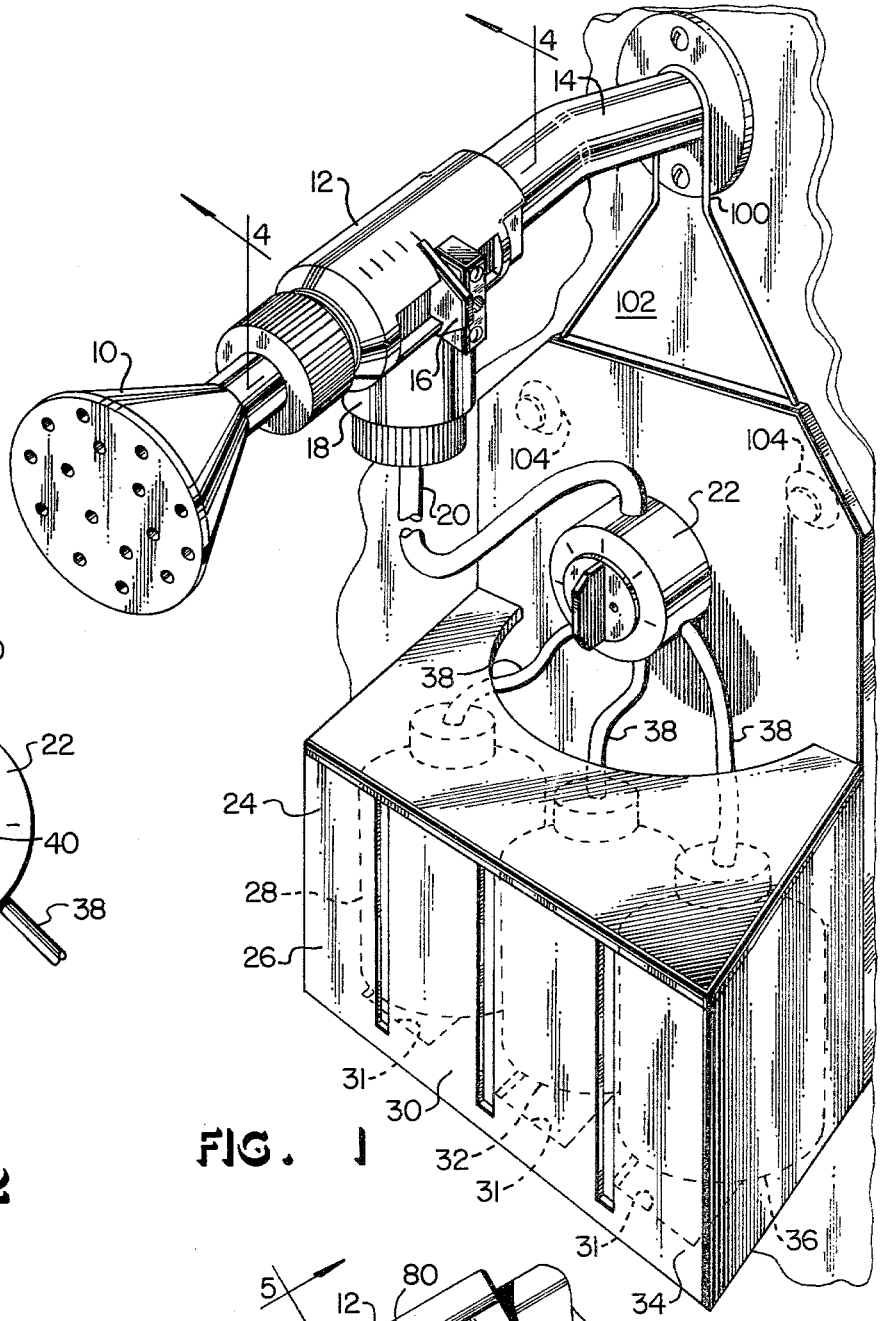
FIG. 1 is a perspective view of one embodiment of the apparatus constructed in accordance with the principles of the present invention and illustrating a shower head and inline valve construction connected to a suspended liquid reservoir.

Referring now to FIG. 1 there is shown one embodiment of shower head attachment apparatus constructed in accordance with the principles of the present invention. As shown in FIG. 1 the shower head 10 has secured therebehind an inline valve 12 constructed in accordance with the present invention and connected to a supply pipe 14 immediately therebehind. The inline valve 12 includes a selector valve 16 installed thereupon having a plurality of selector indications for controlling the amount of liquid dispensed therethrough in conjunction with water flowing through the line 14. Four selector positions are shown for purposes of illustration. The valve 12 further includes a depending cylindrical body portion 18 having secured thereto a flexible hose 20 depending therefrom and interconnecting a selector valve 22 for controlling the fluids passing through said hose. The valve 22 is mounted upon a reservoir bracket, or housing 24, which is suspended from the shower head and preferably attached to the shower wall therebehind. In this manner, the shower head attachment apparatus may be incorporated into any existing shower stall or tub area.

The fluid mixer and dispenser valve of the present invention is constructed for incorporation with a plurality of portable/removable fluid containers. Still referring to FIG. 1, there is shown the housing 24 containing a first compartment 26 having a container 28 therein; a second compartment 30 having a container 32 therein; and a third compartment 34 having a container 36 therein. Each compartment has an aperture 31 formed in the bottom thereof for permitting water to drain therethrough and air to circulate therein. The containers 36, 32 and 28 are shown in phantom for purposes of illustrating the preferably opaque construction of said housing 24. The purpose of the opaque construction is to hide discolorations and water markings normally prevalent with shower areas. For this reason, an elongated slot is formed before each of said compartments to permit visual observation of the fluid container therein and the fluid level thereof. Each of said containers is connected to the selector valve 22 by a flexible hose member 38 for providing fluid transfer. The control valve 22, as will be described in more detail below, selectively controls the transmission of the select fluid into the valve 12 for discharge through the shower head 10.

Figure 2:
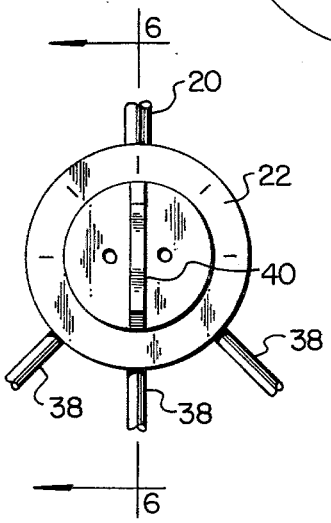
FIG. 2 is an enlarged front elevational view of the selector valve shown in FIG. 1.

Referring now to FIG. 2 there is shown the selector valve 22 in an enlarged front elevational view. The valve 22 is constructed of a generally circular cross-sectional configuration wherein a discharge hose 20 is secured to the upper portion thereof adjacent the three supply hoses 38. A selector dial 40 is provided for selecting the desired fluid flow through the valve 22 and into the shower head 10. The selector dial is preferably large enough (of substantial surface area) to permit easy gripping by someone with wet hands whereby its use is not advantageously facilitated.

Figure 3:
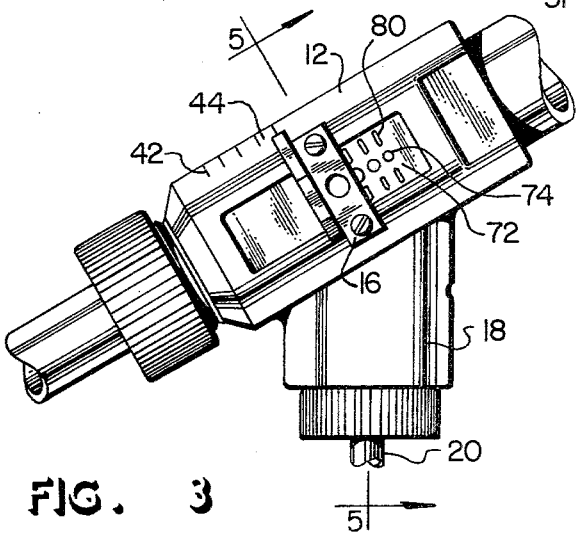
FIG. 3 is an enlarged side elevational view of the inline shower head valve of FIG. 1.

Referring now to FIG. 3, there is shown an enlarged side-elevational view of the control valve 12 and selector mechanism 16 assembled thereon. Indices 42 are provided upon the valve body 44 of the valve head 12 for indicating the magnitude of fluid dispensed therethrough. Four indices are shown and may be numbered or lettered. The cylindrical housing 18, depending therefrom, is provided for communicating the select fluid into and through the water flow stream as will be defined in more detail below.

Figure 4:
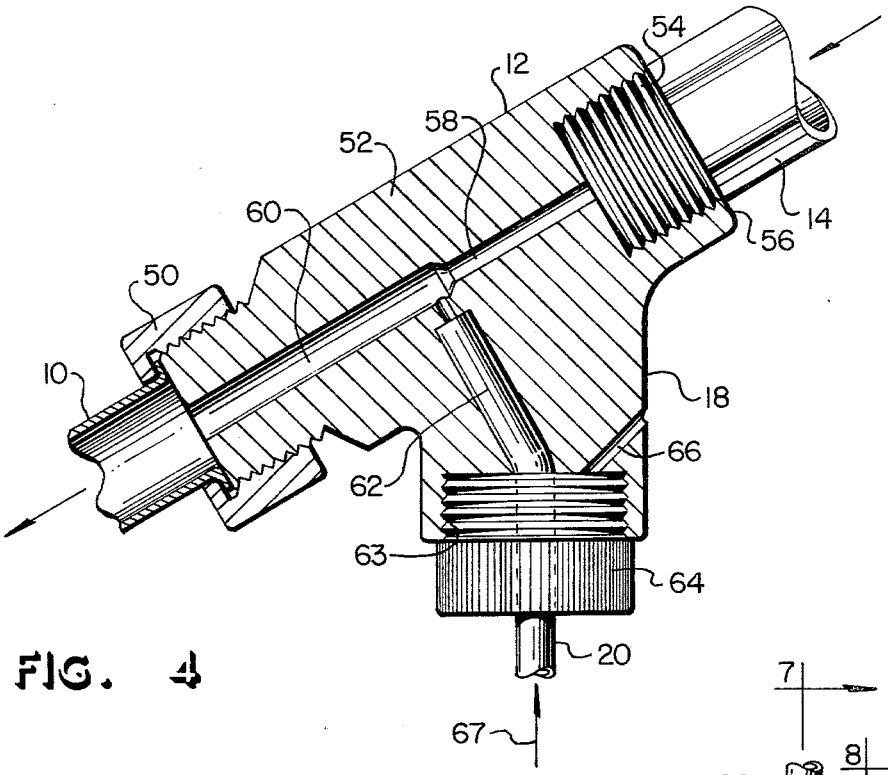
FIG. 4 is an enlarged cross sectional view of the inline valve of FIG. 1 taken along lines 4—4 thereof.

Referring now to FIG. 4, there is shown an enlarged cross section of the valve assembly 12 interconnected to the supply line 14 and the shower head nozzle connection 10. A suitable threaded coupling 50 connects the shower head 10 to the body 52 of the valve 12. A suitable threaded orifice 54 is provided on the aft end 56 of the body 52 for receiving the conventional threaded end of the pipe 14. A communication passage 58 extends from the coupling portion 54 to a lower flow passage 60. The flow passage 60 is in communication with a fluid passage 62 extending upwardly through the cylindrical body portion 18 of the valve 12. In like manner, a suitable threaded coupling member 64 is provided in the lower end of the body portion 18 for connecting the tubular hose member 20 for carrying fluid thereto. It should be noted that coupling 64 is preferably constructed of the same size and thread dimension of the threaded tops of the containers 28, 32 and 36. In this manner said containers can be individually coupled to the valve 12 in place of the line 20.

A vent passage 66 may be seen to be provided adjacent the fluid passage 62 for purposes of ventilation. Fluid is drawn into the hose 20 as indicated by arrow 67 from the "venturi" effect created between passages 58 and 60. Fluid flow through passage 62 then mixes in the passage 60 and is discharged through the shower head 10. The venturi effect permits the various fluids to be utilized directly from their respective containers.

Figure 5:
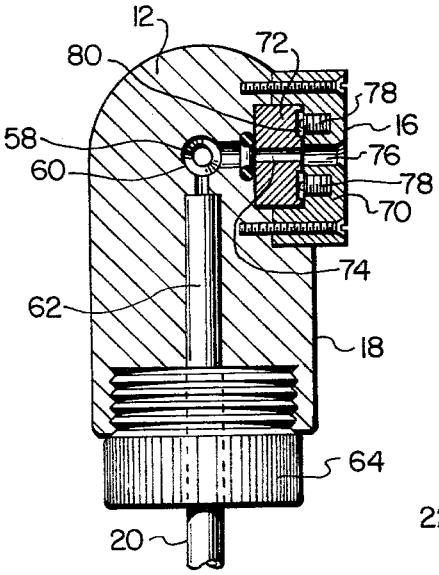
FIG. 5 is an enlarged side elevational cross sectional view of a portion of the inline valve of FIG. 3 taken along lines 5—5 thereof.

Referring now to FIG. 5 there is shown a cross sectional view of the valve 12 taken along lines 5—5 thereof. The sliding selector valve 16 is constructed for regulating the amount of fluid mixture permitted to flow through the valve 12 and is comprised of a stationary vent block 70 and slide block 72. The slide block 72 includes a plurality of apertures 74 formed therethrough with different diameters. The variations in diameter of the apertures 74 (also shown in FIG. 3) permit selective variation in the quantity of air drawn therethrough in place of soap, or the like. Positioning of the select aperture 74 beneath aperture 76 formed in slide block 72 is facilitated by spring biasing elements 78 assembled therein. The spring element 78 engage detent means 80 formed adjacent each aperture 79 for secured positioning and registration of the mating apertures 74 and 76. If less soap or shampoo is desired, a larger aperture 74 is aligned under aperture 76 to reduce the drawing pressure through line 20. In this manner, flow control can be achieved with a minimum of moving parts, valve seats, gaskets and related components of many prior art flow regulators.

Figure 6:
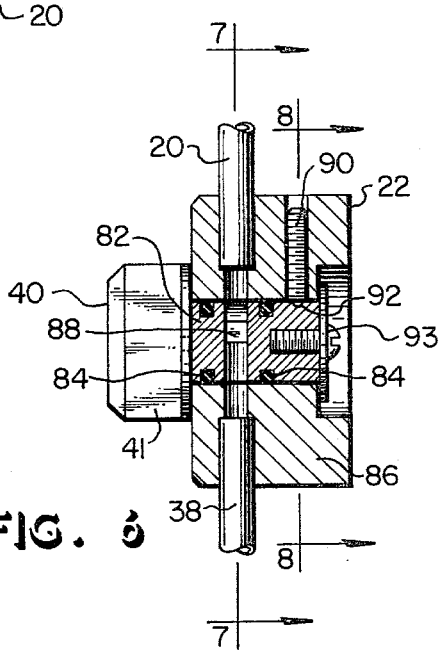
FIG. 6 is an enlarged side elevational cross sectional view of the selector valve of FIG. 2 taken along lines 6—6 thereof.

Referring now to FIG. 6 there is shown a side elevational, cross sectional view of the selector valve 22 of FIG. 2. The valve 22 preferably includes a selector dial 40 with an enlarged flange portion 41 for facilitating gripping for turning with wet hands and with one's eyes closed. A ported shaft 82 is connected to the selector dial 40 and keyed for rotation therewith. Suitable O-rings 84 are provided between the shaft 82 and housing 86 of the valve 22 on opposite side of venting mouth 88 formed therethrough. The mouth 88 is provided in a configuration facilitating a selective fluid communication channel through the housing 86 between the upper supply hose 20 and lower supply hoses 38. A spring biasing member 90 is likewise provided for engaging suitable detent means 92 formed in the body of the shaft 82 for positioning and registration functions thereof.

Figure 7:
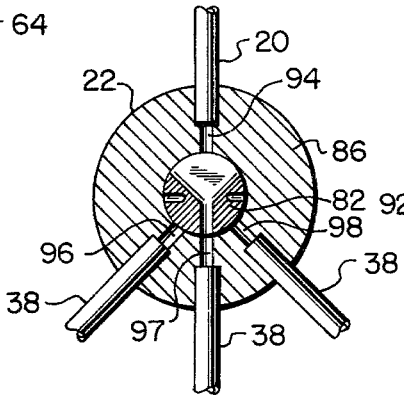
FIG. 7 is an enlarged top plan cross sectional view of the selector valve of FIG. 6 taken along lines 7—7 thereof.

Referring now to FIG. 7, there is shown a front elevational, cross sectional view of the valve 22 of FIG. 2. Housing 86 is shown to include a single outlet port 94 and three inlet ports 96, 97 and 98, each connected to a supply hose 38. The shaft 82 is constructed with venting mouth 88 formed in a Y-shaped configuration which permits individual venting of the separate supply lines 38 to the upper line 20 through small angular rotation of the shaft 82.

Figure 8:
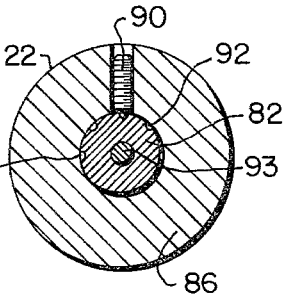
FIG. 8 is a top plan cross sectional view of the selector valve of FIG. 6 taken along lines 8—8 thereof.

Referring now to FIG. 8, there is shown another cross-sectional view of the valve 22 of FIG. 6, wherein the spring biasing member 90 is shown engaging one of a series of detent areas 92. Each detent area 92 is formed upon the circumferential periphery of the shaft 82 for facilitating rotational positioning. In this manner, the valve 22 can be turned until the spring member 90 "snaps" into one of said detent areas. This engagement offers some resistance to further turning which assists an operator in detecting another valve position. This feature has been shown to be particularly advantageous in the shower when the operator has his eyes closed due to soap and the like about his face.

In operation, the apparatus of the present invention can be quickly assembled to any conventional shower head 10. Unlike most prior are constructions, a multiple liquid selection is possible without the disadvantages of a permanent plumbing installation. Referring again to FIG. 1, there is shown the housing 24 suspended from the shower head 10 by a bracket 100. The bracket 100 supports the vertical loading of the housing 24 which housing is stabilized against the shower wall 102 by a series of suction cups 104 secured upon the back of said housing. In this manner the housing 24 is rigidly supported from the shower head 10 and portably affixed to the shower wall in a mode facilitating quick mounting or demounting of the unit. As stated above, the lower threaded end 63 of the valve 12 is preferably formed for direct mating engagement with the various containers 28, 32 and/or 36. In this manner the housing 24 may be eliminated when only one type of liquid is desired. The three containers facilitate the use of soap, shampoo and a bath oil. The regulatory feature of 12 permits interchangability between such diverse elements by controlling the respective flow rates. Certain liquids will be used at greater rates than others thus necessitating selectivity in flow volume.

It is thus believed that the operation and construction of the present invention will be apparent from the foregoing description. While the apparatus as shown and described has been characterized as being preferred it will be obvious that various changes and modifications may be made therein without departing from the spirit and scope of the invention as defined in the following claims.

What is claimed is:

1. An improved, portable shower head fluid dispenser for shower stalls and tub areas of the type including a shower spray nozzle disposed on the end of a fluid dispenser valve block removably coupled to a water supply pipe wherein select fluid such as soap is passed through the valve block in selected quantities to mix with the shower water at the selection of a person in the shower, wherein the improvement comprises a removable valve block having a flow channel formed therethrough with a lower portion of greater diameter than an upper portion and provided for passage of shower water therethrough, said valve block having a depending communication passage formed generally orthogonal to said flow channel and communicating with said flow channel in the area of the interface between said lower and upper portions wherein a selectable venturi draft will be imparted to said depending communication passage and wherein said valve block includes a venting channel extending outwardly from the flow channel, a stationary vent block having an aperture therethrough adapted to communicate with said venting channel, and a slide block having a plurality of apertures of varying diameter formed therethrough, said slide block mounted for rectiliner movement parallel to said flow channel and vented to the atmosphere for select communication with said flow channel and selective control of said venturi draft, by varying the restrictions in said venting channel a fluid supply reservoir housing portably suspended beneath said shower head and supporting at least one fluid container, said housing including means for permitting visual observation of the fluid level in the container received therein and each container being connected in flow communication with said valve block through tubular members supplying the fluid to said valve block for discharge therefrom, said tubular members being in communication with said depending passage and one of said containers wherein a venturi draft will precipitate fluid flow therebetween, and a selector valve comprised of a ported shaft having apertures formed therethrough for opening, closing and channeling fluid flow therein, said shaft having a plurality of detent areas for rotational positioning in proper open and closed registration facilitating fluid flow operation in a shower stall area, said valve also including a selector dial of substantially enlarged surface area for facilitating valve selection by a person having wet hands and limited vision in the shower, and said valve being disposed between said valve block and said fluid supply housing and in communication with said tubular members between said valve block and said fluid supply housing for channeling the select fluid flow therebetween in response to said valve block.

2. The improved shower head fluid dispenser as set forth in claim 1, wherein said housing is formed of opaque plastic for containing said fluid containers behind non-transparent walls.

3. The improved shower head fluid dispenser as set forth in claim 1, wherein said housing includes at least two suction cups affixed to a rear surface thereof for engaging a wall in the shower stall area beneath the shower head and securing said housing thereagainst.

4. The improved shower head fluid dispenser as set forth in claim 1, wherein said valve block includes a dispensing section housing said depending communication passage therein, which depending section includes a threaded mounting region for coupling to said tubular members carrying select fluid to said valve block.

5. The improved shower head fluid dispenser as set forth in claim 4, wherein said threaded mounting region is constructed for directly matingly engaging a single fluid container in fluid flow communication.

* * * * *